US006769931B2

(12) United States Patent
Negishi et al.

(10) Patent No.: US 6,769,931 B2
(45) Date of Patent: Aug. 3, 2004

(54) CONNECTOR FOR CONNECTING ELECTRIC WIRE OF ADDED DEVICE WITH PROVIDED ELECTRIC WIRE

(75) Inventors: Satoshi Negishi, Shizuoka (JP); Hirohisa Ueda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 15 days.

(21) Appl. No.: 10/345,965

(22) Filed: Jan. 17, 2003

(65) Prior Publication Data

US 2003/0181093 A1 Sep. 25, 2003

(30) Foreign Application Priority Data

Mar. 20, 2002 (JP) ..... 2002-078162

(51) Int. Cl.[7] ..... H01R 4/24; H01R 4/26; H01R 11/20

(52) U.S. Cl. ..... 439/404; 439/402; 439/409

(58) Field of Search ..... 43/404, 409–410, 43/402, 417, 596

(56) References Cited

U.S. PATENT DOCUMENTS 4,997,388 A * 3/1991 Dale et al. ..... 439/404
5,190,468 A * 3/1993 Nichols et al. ..... 439/404
5,199,899 A * 4/1993 Ittah ..... 439/403
5,338,220 A * 8/1994 Soes et al. ..... 439/403
5,562,478 A * 10/1996 Yamamoto ..... 439/402
5,664,963 A * 9/1997 Yamamoto et al. ..... 439/409
5,820,404 A * 10/1998 Chishima et al. ..... 439/417

FOREIGN PATENT DOCUMENTS

JP 4-342969 11/1992

* cited by examiner

*Primary Examiner*—Hae Moon Hyeon
(74) *Attorney, Agent, or Firm*—Armstrong, Kratz, Quintos, Hanson & Brooks, LLP

(57) ABSTRACT

A connector, connecting an electric wire of a newly added electronic device with a provided electric wire easily, has a first connector housing 11, a terminal 12, a second connector hosing 13 and a pressure contact terminal. The first connector housing 11 has a terminal receiving portion 16 and a wire holding portion 17. The wire holding portion 17 holds a provided electric wire 7. The terminal 12 is connected with a first electric wire 3 of the newly added electronic device. The second connector housing 13 is supported slidably along a direction B intersecting with the first electric wire 3. The second connector hosing 13 holds the pressure contact terminal contacted with pressure to the second electric wire 7.

7 Claims, 13 Drawing Sheets

CONNECTOR FOR CONNECTING ELECTRIC WIRE OF ADDED DEVICE WITH PROVIDED ELECTRIC WIRE

BACKGROUND OF THE INVENTION

1. Field of the Invention

This invention relates to a connector for connecting electric wires mutually.

2. Description of the Related Art

In an automobile as a mechanical apparatus, various electronic devices are installed. Therefore, in the automobile, a wiring harness is provided to supply various information or electric power to the electronic devices. The wiring harness has plural covered wires and connectors joined to ends of the electric wires. The wiring harness is connected with connectors of the electronic devices for supplying various information or electric power.

New electronic devices may be installed additionally correspondingly to a user request in the automobile. Supplying information or electric power to the new electronic devices is required. Therefore, a connector for electrically connecting an electric wire to supply information or electric power to the new electronic devices with the wire harness provided previously in the automobile, for example a connector shown in J.P.A H4-342969, is used.

The connector described in J.P.A H4-342969 includes a body with a groove, a U-shape terminal supported rotatably by the body and a cover. The above-mentioned electric wire mounted previously is placed in the groove. The U-shape terminal is joined to en electric wire connecting with the newly additional electronic device. The cover is formed into box-shape receiving the body therein.

In the connector structured above, an opening of the U-shape terminal is placed correspondingly to an opening of the groove, and the electric wire mounted previously is inserted into the openings. The U-shape terminal cuts a covering portion of the electric wire by turning the U-shape terminal and the U-shape terminal and the electric wire in the groove are connected. Thereafter, covering the body with the cover, the cover is fixed on the body. Thus, the electric wire mounted previously is prevented from escaping unexpectedly from the groove.

Objects to be Solved

In the connector mentioned above, firstly the electric wire mounted previously is inserted into the groove for electrically connecting the electric wire joined to the U-shape terminal with the electric wire mounted previously. Thereafter, the U-shape terminal is turned and the body is covered with the cover. Therefore, many operations for electrically connecting the electric wire joined to the U-shape terminal with the electric wire mounted previously are required. Furthermore, the electric wire mounted previously is placed in very small space and operation of turning the U-shape terminal and fixing the cover. on the body has to be done in such small space. Thus, many operations for connecting are required and also the operations are done in difficult condition. Therefore, operating time for connecting electric wires may be extended.

To overcome the above drawback, one object of this invention is to provide a connector which can connect easily an electric wire from a newly additional electronic device with an electric wire mounted previously.

SUMMARY OF THE INVENTION

How to Attain the Object

In order to attain the objects, a connector, according to this invention, includes a terminal connected electrically with a first electric wire, a first connector housing receiving the terminal, a second connector housing slidable against the first connector housing, and a pressure contact terminal, held in the second connector housing and contacted electrically to a second electric wire, and being connectable electrically with the terminal, wherein the first connector housing is provided with a wire holding portion for holding the second electric wire, wherein the second connector housing is slidable freely against the first connector housing along a direction intersecting with the first electric wire, wherein the pressure contact terminal is contacted with pressure to the second electric wire by sliding the second connector housing toward the wire holding portion of the first connector housing holding the second electric wire.

According to the connector as mentioned above, holding the second electric wire in the wire holding portion, and sliding the second housing connector toward the wire holding portion, the pressure contact terminal is contacted with pressure to the second electric wire. The pressure contact terminal is connected electrically with the terminal connected electrically with the first electric wire. Thus, to contact the pressure contact terminal with pressure to the second electric wire by holding the second electric wire in the wire holding portion and sliding the second housing connector toward the wire holding portion, the first electric and the second electric wire are electrically connected mutually.

The connector as mentioned above is more specified that the wire holding portion has a cutout formed in the first connector hosing by cutting out along lengthwise of the first electric wire, and holds the second electric wire so as to intersect with the first electric wire passed therethrough.

According to the connector as mentioned above, the cutout is formed in the first connector housing so that the wire holding portion can hold securely the second electric wire intersecting with the first electric wire. Therefore, the second electric wire can be placed easily in the wire holding portion and can be contacted securely with pressure to the pressure contact terminal.

The connector as mentioned above is furthermore specified that the second connector housing has a second cutout formed along a direction of sliding toward the first connector housing to make the second electric wire pass through the second cutout.

According to the connector as mentioned above, the second cutout is formed along a direction of sliding against the first connector housing in the second connector housing. Thereby, a direction of the cutout in the first connector housing and a direction of the second cutout in the second connector housing intersect to each other. Therefore, when the pressure contact terminal is contacted with pressure to the second electric wire by sliding the second connector housing toward the wire holding portion, the cutout and the second cutout cover the outside of the electric wires.

The connector as mentioned above is furthermore specified that the terminal is connected with the pressure contact terminal by sliding the second connector housing toward the wire holding portion of the first connector housing holding the second electric wire.

According to the connector as mentioned above, the terminal is electrically connected with the pressure contact terminal by sliding the second connector housing toward the wire holding portion. Therefore, contacting the second electric wire with pressure to the pressure contact terminal, the first electric wire and the second electric wire are electrically connected securely with each other.

The connector as mentioned above is furthermore specified that the terminal has a first electric contact portion for being connected electrically with the pressure contact terminal, and the pressure contact terminal has a second electric contact portion for being connected electrically with the terminal, and the first electric contact portion and the second electric contact portion are contacted mutually in a direction of lengthwise of the first electric wire so as to create respectively elastic restoring forces in a direction of approaching each other along lengthwise of the first electric wire, when the second electric wire is contacted with pressure to the pressure contact terminal by sliding the second connector housing toward the wire holding portion.

According to the connector as mentioned above, the first electric contact portion of the terminal and the second electric contact portion of pressure contact terminal contact mutually in a direction of lengthwise of the first electric wire so as to create respectively elastic restoring forces in a direction of approaching each other. Therefore, sliding the second connector housing toward the wire holding portion, the terminal and the pressure contact terminal are electrically connected securely with each other so that the first electric wire and the second electric wire are electrically connected securely with each other.

The connector as mentioned above is furthermore specified that the terminal has a first bottom wall for placing the first electric wire thereon, and the pressure contact terminal has a second bottom wall for placing the second electric wire thereon, and the first electric contact portion is formed into plate rose from the first bottom wall and has a contact piece movable freely along lengthwise of the first electric wire at the remote end thereof from the first bottom wall, and the second electric contact portion is formed into plate rose from the second bottom wall and has a contact piece movable freely along lengthwise of the first electric wire at the remote end thereof from the second bottom wall.

According to the connector as mentioned above, the first and second electric contact portions are formed respectively rising from the first or second bottom wall and the remote end of the first or second electric contact portions from the first or second bottom wall is movable freely along lengthwise of the first electric wire. Thereby, when the second connector housing is slid toward the wire holding portion, the first electric contact portion of the terminal and the second electric contact portion of the pressure contact terminal are contacted mutually and create securely elastic restoring forces in a direction of approaching each other along lengthwise of the first electric wire. Therefore, the terminal and the pressure contact terminal are electrically connected securely with each other so that the first electric wire and the second electric wire are electrically connected securely with each other.

The connector as mentioned above is furthermore specified that the first connector housing is provided with a lever member supported freely and rotatably thereto for sliding the second connector housing toward the first connector housing by the rotation thereof.

According to the connector as mentioned above, the second connector housing is slid by the rotation of the lever member. Thereby, the second connector housing can be slid securely to contact the pressure contact terminal with pressure to the second electric wire securely. Furthermore, the second connector housing can be slid with small force under lever operation.

The above and other objects and features of this invention will become more apparent from the following description taken in conjunction with the accompanying drawings.

BRIEF DESCRIPTION OF THE DRAWINGS

FIG. 2 is a perspective view of the connector in FIG. 1 which an electric wire is not connected with;

FIG. 21 is a perspective view of the connector in FIG. 20 which the second electric wire will be connected with.

DESCRIPTION OF THE PREFERRED EMBODIMENT

Figure 1:
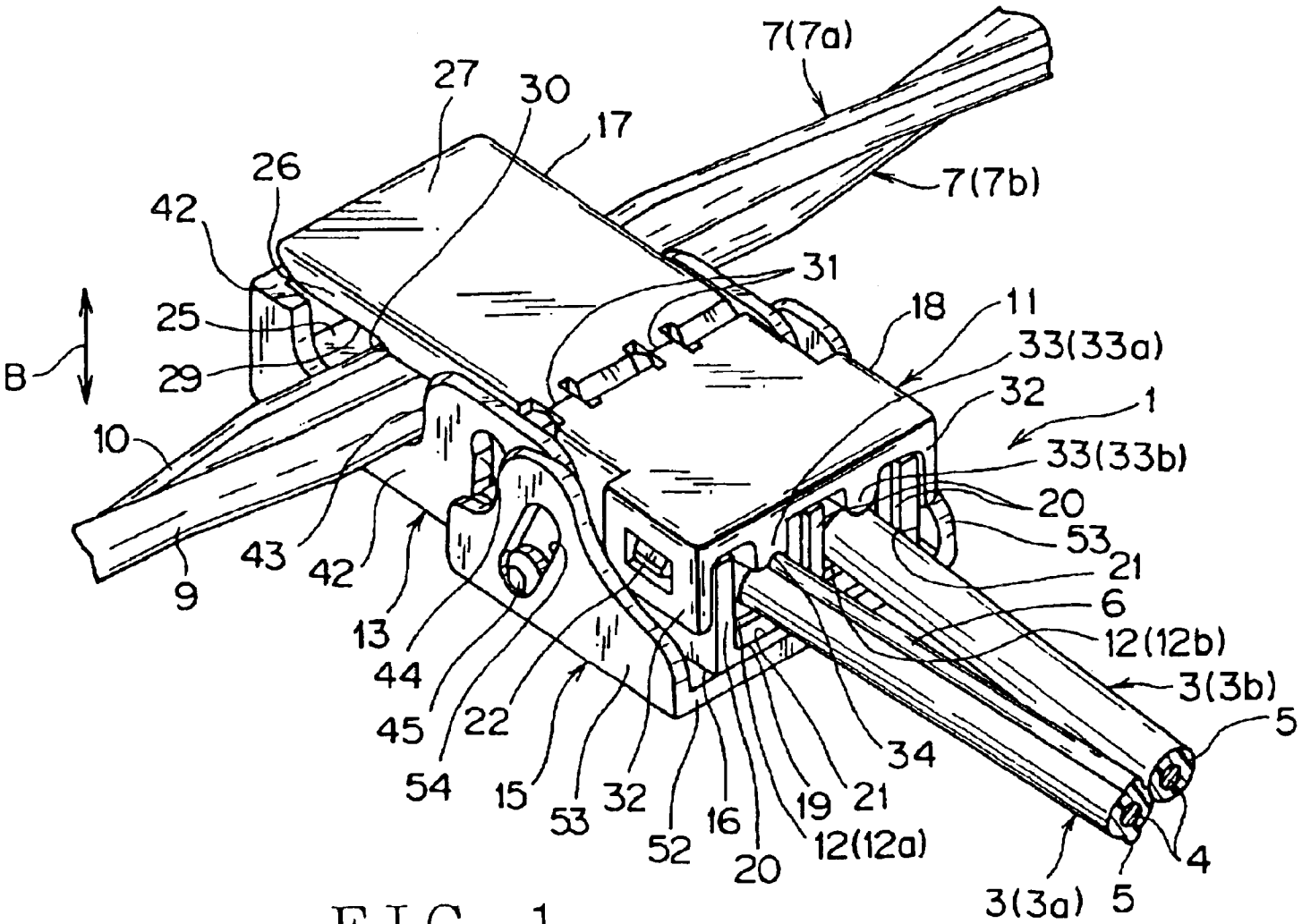
FIG. 1 is a perspective view of a connector of the first embodiment according to this invention.

A connector of a first embodiment according to this invention will now be described with reference to FIGS. 1–19. A connector 1 shown in FIG. 1, structuring a wire harness installed in an automobile, is used to connect electrically a pair of electric wires 7 (call the second electric wire hereafter) mounted previously in the automobile and a pair of electric wires 3 (call the first electric wire hereafter) connected with a newly additional electronic device in the automobile.

The first electric wire 3 is a covered electric wires having an electrically conductive core wire 4 and an insulating cover portion 5 for covering the core wire 4. One of the pair of the first electric wires 3 (indicating 3*a* hereafter) is provided with a projection 6. The projection 6 projects from an outer surface of the cover portion 5 in radial direction of the one first electric wire 3*a* along full length of the one first electric wire 3*a*. The other first electric wire 3 (indicating 3*b* hereafter) is formed to have a round section.

Figure 15:
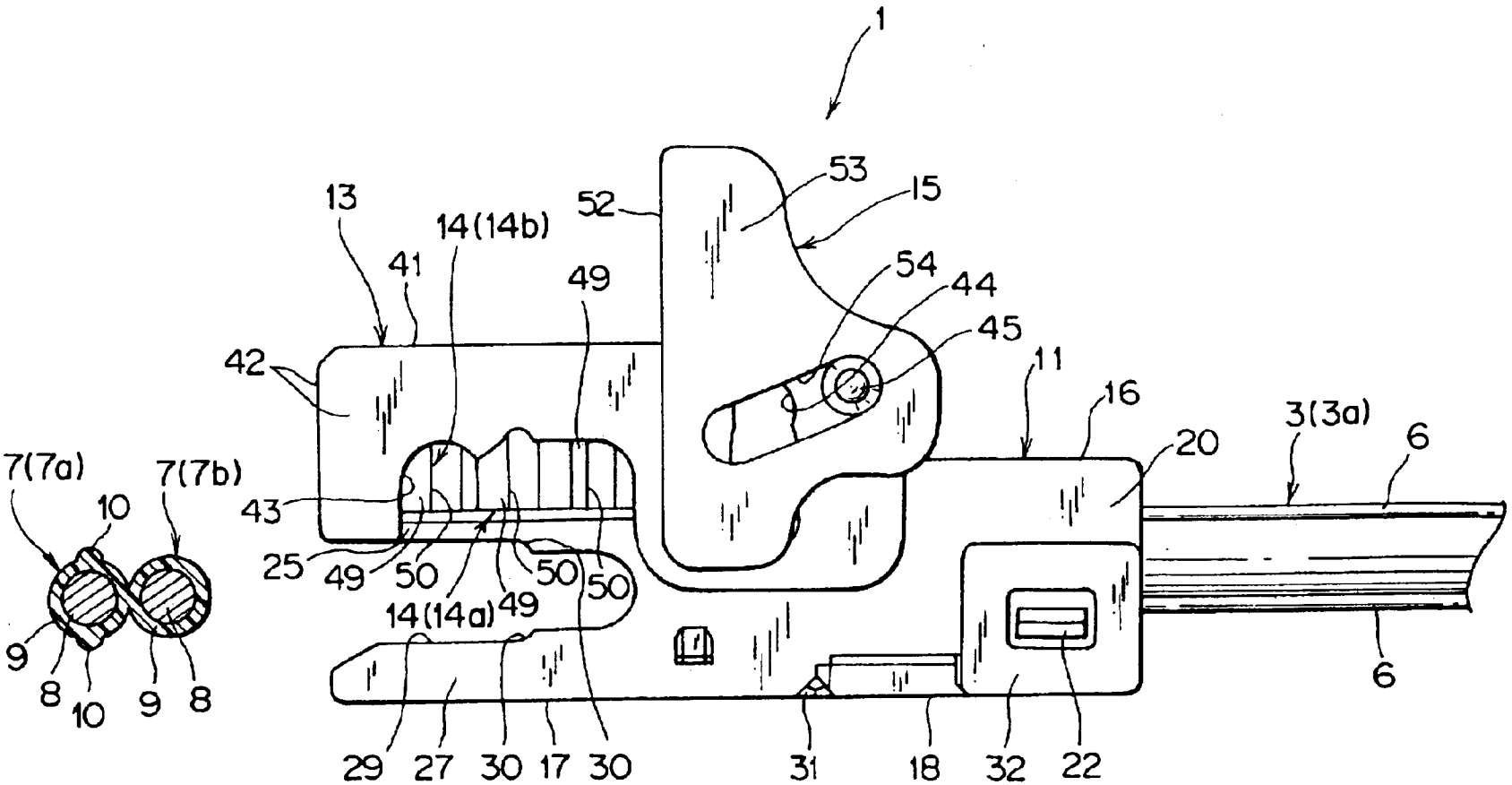
FIG. 15 is a side view of the connector and the wires shown in FIG. 14.

The second electric wire 7, as shown in FIG. 15, is a covered electric wire having a electrically conductive core wire 8 and an insulating cover portion 9 for covering the core wire 8. One of the pair of the second electric wires 7 (indicating 7*a* hereafter) is provided with a projection 10. The projection 10 projects from an outer surface of the cover portion 9 in radial direction of the second electric wire 7*a* along full length of the second electric wire 7*a*. The other second electric wire 7 (indicating 7*b* hereafter) is formed to have a round section.

The connector 1, as shown in FIG. 1, includes a first connector housing 11, a pair of terminals 12 (shown in FIGS. 2–4), a second connector housing 13, a pair of pressure contact terminals 14 (shown in FIG. 4) and a lever member 15. The first connector housing 11 is formed into box-shape with electric nonconductive synthetic resin. The first connector housing 11, as shown in FIGS. 1–4) has a terminal receiving portion 16, a wire holding portion 17 and a cover 18. The terminal receiving portion 16 has a wall 19 for placing the terminal 12 thereon and three standing walls 20 standing from the wall 19.

The standing walls 20 are disposed in parallel to each having the same spacing. A terminal receiving groove 21 for receiving the terminal 12 is formed between mutually adjacent standing walls. The terminal receiving grooves 21 are linearly formed mutually in parallel. A pair of standing walls 20 of the three standing walls 20, forming outer shell of the terminal receiving portion 16, i.e. the first connector housing 11, are provided respectively with a engaging projection 22 and a slide projection 23.

The engaging projection 22 and the slide projection 23 project from the pair of standing walls 20 toward outside of the terminal receiving portion 16, i.e. the first connector housing 11. The slide projection 23 is mounted at an end portion near the wire holding portion 17 of the standing wall 20. A recess 24 (shown in FIG. 4) is formed on an end face of the slide projection 23. The engaging projection 22 is mounted at a remote end portion from the wire holding portion 17 of the standing wall 20.

The wire holding portion 17 continuous to the terminal receiving portion 16 along lengthwise of the terminal receiving grooves 21. The wire holding portion 17 is formed into box-shape having a wall 25 continuous to the wall 19, a pair of side walls 26 and a wall 27 opposite to the wall 25 with a space.

The wall 25 is formed with a throughhole 28 (shown in FIG. 2) to allow a contact blade 49 of a pressure contact terminal 14 mounted in the second connector housing 13 going therethrough. The pair of side walls 26 are continuous to the pair of standing walls 20 forming an outer shell of the terminal receiving portion 16. The pair of side walls 26 rise from the wall 25. The pair of side walls 26 are formed respectively with a cutout 29. The cutout 29 is formed on the side wall 26 from a remote end portion from the terminal receiving portion 16 of the side wall 26 toward the terminal receiving portion 16. Therefore, the side wall 26 is formed into U-shape when viewed from side. The cutout 29 is formed on the side wall 26, i.e. the first connector housing 11 along lengthwise of the first electric wires 3*a*, 3*b* contacted with pressure to the terminal 12 received in the terminal receiving portion 16.

A step 30 for abutting on the projection 10 of the one second electric wire 7*a* is provided at a center portion of lengthwise of the cutout 29. Owing to the step 30, the one second electric wire 7*a* cannot be inserted over the center portion of the cutout 29. The other second electric wire 7*b* can be inserted into the inner part of the cutout 29. The walls 27 are continuous to the pair of the side walls 26 in parallel to the wall 25.

According to above structure, the second electric wires 7*a*, 7*b* can be inserted through the cutout 29 into the wire holding portion 17, i.e. between the wall 25 and the wall 27. A direction of lengthwise of the second electric wires 7*a*, 7*b* inserted through the cutout 29 into the wire holding portion 17 crosses perpendicularly (intersects) a direction of lengthwise of the first electric wires 3*a*, 3*b* joined to the terminal 12. Thus, the wire holding portion 17 can hold the second electric wires 7*a*, 7*b* so as to intersect with the first electric wires 3*a*, 3*b*.

The cover 18 is continuous through a hinge 31 to the wire holding portion 17. The hinge 31 is continuous to an edge of the wall 27. The cover 18 is formed into plate. The cover 18 is rotatable freely by the hinge 31 against the terminal receiving portion 16. The cover 18 has a cover-lock arm 32 for engaging with the engaging projection 22. The cover 18 rotates around the hinge 31 between a position to hang over the wall 27 shown in FIG. 2 and open a side remote from the wall 19 of the terminal receiving groove 21 of the terminal receiving portion 16, and a position to engage the cover lock arm 32, shown in FIG. 1, with the engaging projection 22 and cover the side remote from the wall 19 of the terminal receiving groove 21 oppositely with a gap to the wall 19 of the terminal receiving portion 16.

Figure 2:
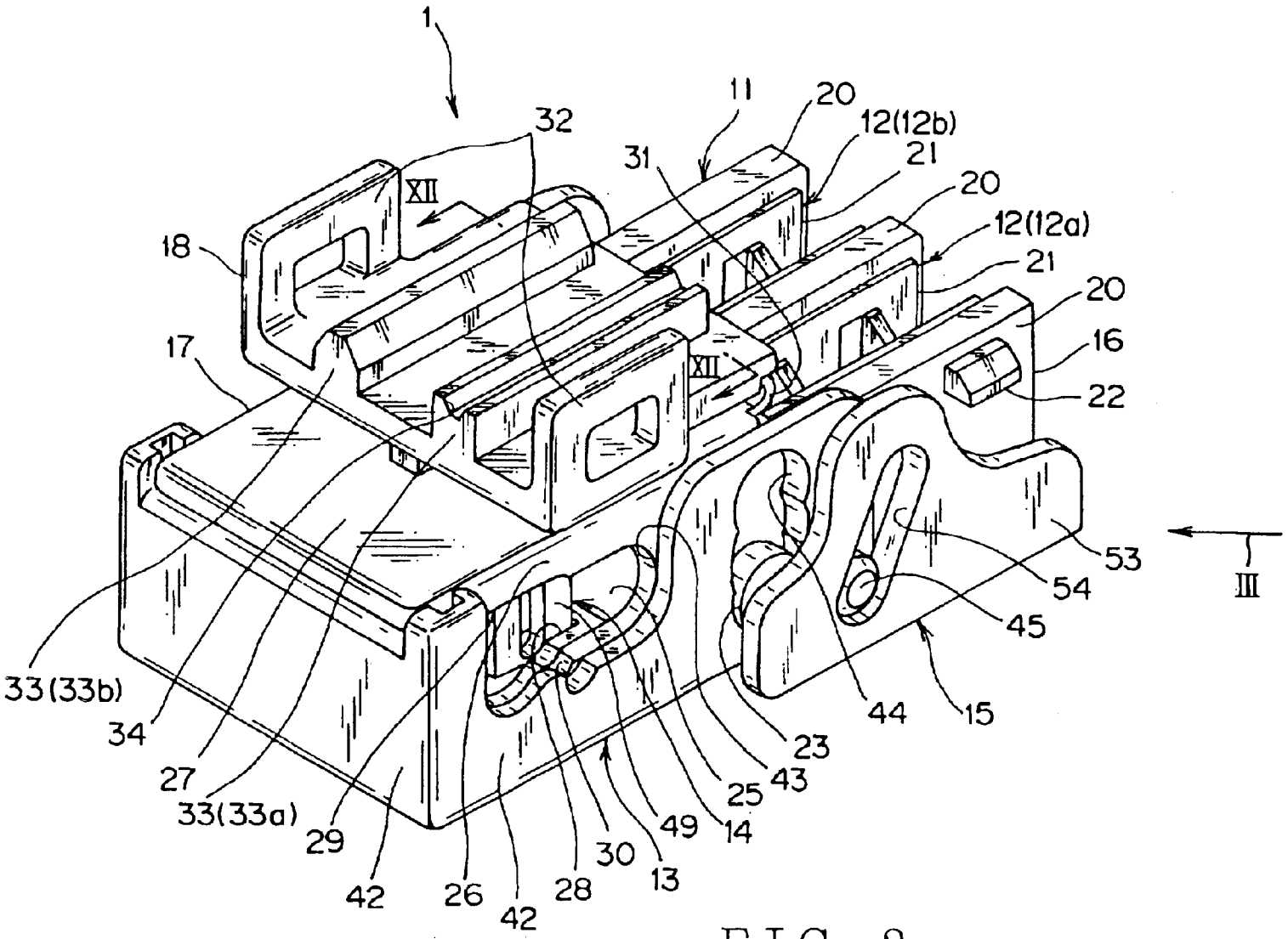
Figure 3:
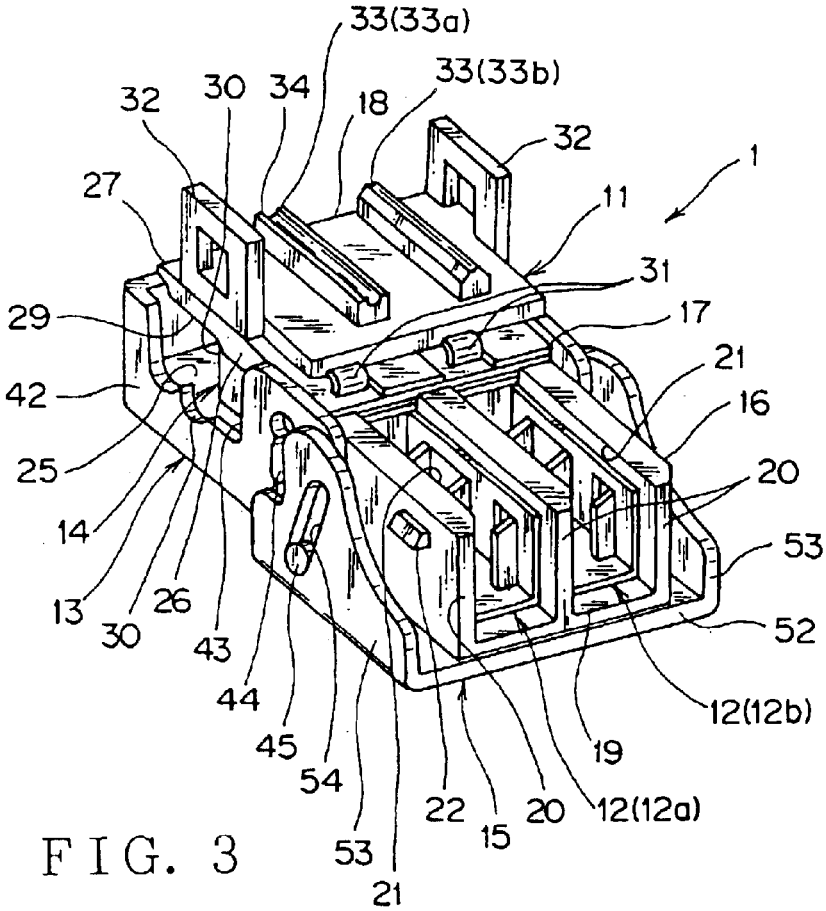
FIG. 3 is a perspective view of the connector when viewing from an arrow III in FIG. 2.
Figure 12:
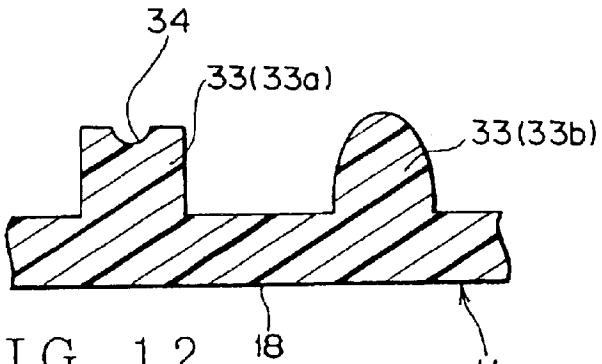
FIG. 12 is a sectional view taken along the line XII—XII in FIG. 2.

The cover 18 is further provided with a pair of projections 33 for distinguishing electric wires. When the cover 18 covers the terminal receiving grooves 21, the pair of projections 33 go respectively into the terminal receiving grooves 21. One of the pair of projections 33 (indicate 33*a* hereafter) is formed with a concave groove 34 caved from an edge surface thereof, as shown in FIG. 2 or 12. The concave groove 34 is formed along full length of the one projection 33*a*. The projection 6 of the one first electric wire 3*a* goes into the concave groove 34. Even if the projection 6 goes into the concave groove 34, the cover lock arm 32 of the cover 18 can engage with the engaging projection 22.

Thus, the one projection 33*a* allows the cover lock arm 32 engaging with the engaging projection 22 in condition that the projection 6 goes into the concave groove 34. Therefore, the one projection 33*a* allows the one first electric wire 3*a* contacting with pressure to the terminal 12 received in the terminal receiving groove 21.

The other projection 33 (indicate 33*b* hereafter) hinders the cover lock arm from engaging with the engaging projection 22 to interfere with the projection 6 when the one first electric wire 3*a* is contacted with pressure with the terminal 12 received in the terminal receiving groove 21. Thus, the other projection 33*b* hinders the cover lock arm 32 from engaging with the engaging projection 22 by interfering with the projection 6 so that the one first electric wire 3*a* is prevented from contacting with pressure to the terminal 12 received in the terminal receiving groove 21.

The one projection 33*a* of the pair of projections 33*a*, 33*b* allows the one first electric wire 3*a* being placed in the terminal receiving groove 21. The other projection 33*b* hinders the one first electric wire 3*a* from being placed in the terminal receiving groove 21. Thereby, the pair of projections 33*a*, 33*b* classify the pair of the first electric wires to the one first electric wire 3*a* and the other first electric wire 3*b* placed respectively in the terminal receiving grooves 21. Thus, the first connector housing 11 holds the first electric wires 3*a*, 3*b*.

Figure 5:
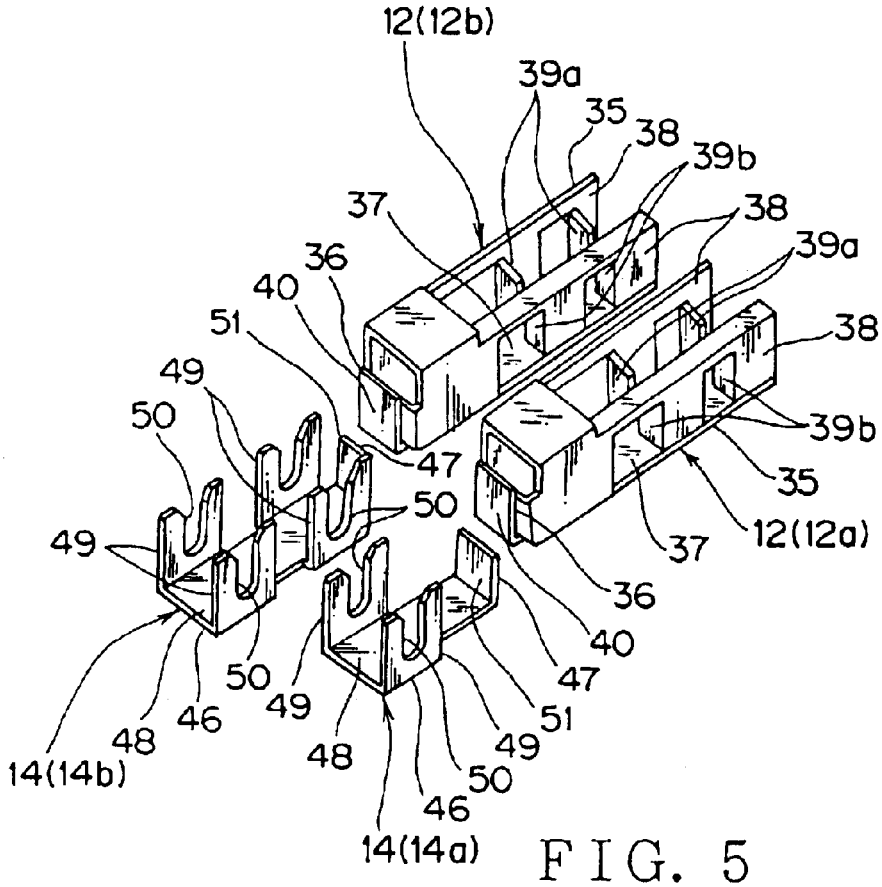
FIG. 5 is a perspective view of terminals and pressure contact terminals of the connector shown in FIG. 1.
Figure 7:
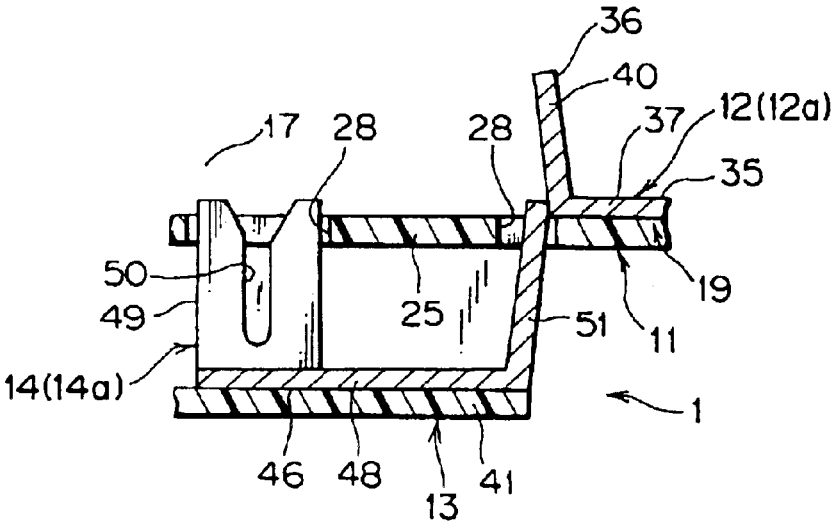
FIG. 7 is a sectional view, showing the second connector housing started to be slid toward the wire holding portion from the condition shown in FIG. 6.
Figure 8:
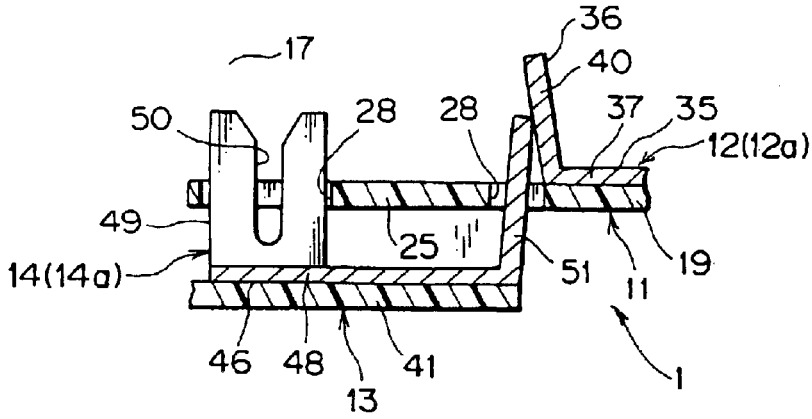
FIG. 8 is a sectional view, showing the second connector housing slid more toward the wire holding portion from the condition shown in FIG. 7.
Figure 9:
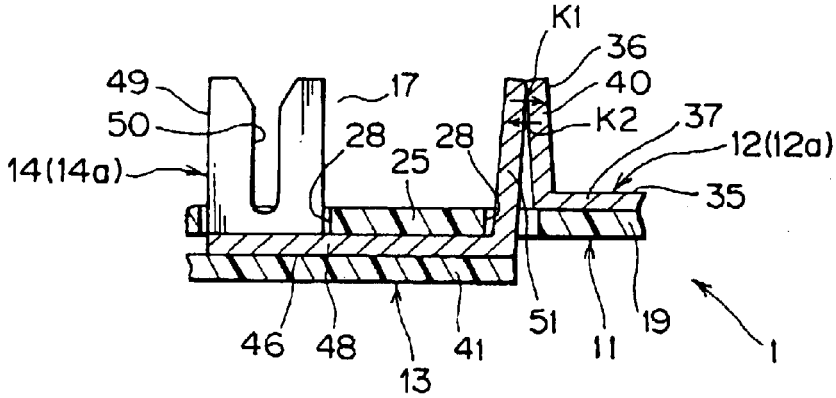
FIG. 9 is a sectional view, showing the second connector housing slid completely toward the wire holding portion from the condition shown in FIG. 8.
Figure 10:
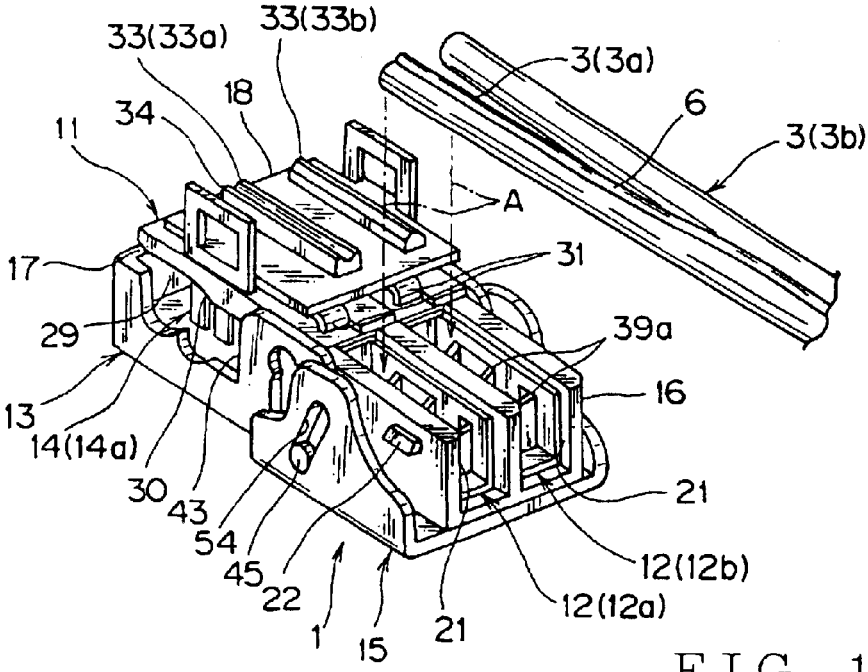
FIG. 10 is a perspective view, showing the first electric wires will be contacted with pressure to terminals of the connector shown in FIG. 3.

The terminal 12, as shown in FIG. 5, has a wire connecting portion 35 and a first electric contact portion 36 connected electrically with the pressure contact terminal 14. The wire connecting portion 35 has a first bottom wall 37 on which the first electric wire 3*a* or 3*b* is placed, a pair of side walls 38 and plural pairs of pressure contact blades 39*a*, 39*b*. The first bottom wall 37 is formed into rectangular shape when viewed from top. The lengthwise of the first bottom wall 37 is parallel to the lengthwise of the first electric wires 3*a*, 3*b* placed thereon.

The pair of side walls 38 rise from both edges of width of the first bottom wall 37. The pair of side walls 38 are opposite mutually with spacing. Plural pairs of pressure contact blades 39*a*, 39*b* extend from the pair of side walls 38 to approach each other so as to cut into the cover portion 5 of the first electric wires 3*a*, 3*b* for contacting to the core wires 4 of the first electric wires 3*a*, 3*b*. The wire connecting portions 35, i.e. the terminals 12, are connected electrically with the core wires 4. In other words, the wire connecting portions 35, i.e. the terminals 12, are contacted with pressure to the first electric wires 3*a*, 3*b*.

The first electric contact portion 36 has a plate-like contact piece 40 continuous to the electric wire connecting portion 35. The contact piece 40 rises from the first bottom wall 37 in the same direction as the pair of side walls 38. A remote end of the contact piece 40 from the first bottom wall 37 is movable freely along lengthwise of the first electric wire 3*a* or 3*b* contacted with pressure to the electric wire connecting portion 35. The contact piece 40 is elastically deformable freely in the direction mentioned above.

The terminal structured above is received into the terminal receiving groove 21 of the terminal receiving portion 16 of the first connector housing 11. Thus, the terminal 12 is held in the first connector housing 11. Pushing the first electric wires 3*a*, 3*b* between the pressure contact blades 39*a*, 93*b*, the pressure contact blade 39*a* or 93*b* cuts into the cover portion 5 and contacts to the core wire 4. Thereby, the terminal 12 is connected electrically with the first electric wire 3*a* or 3*b*.

Figure 4:
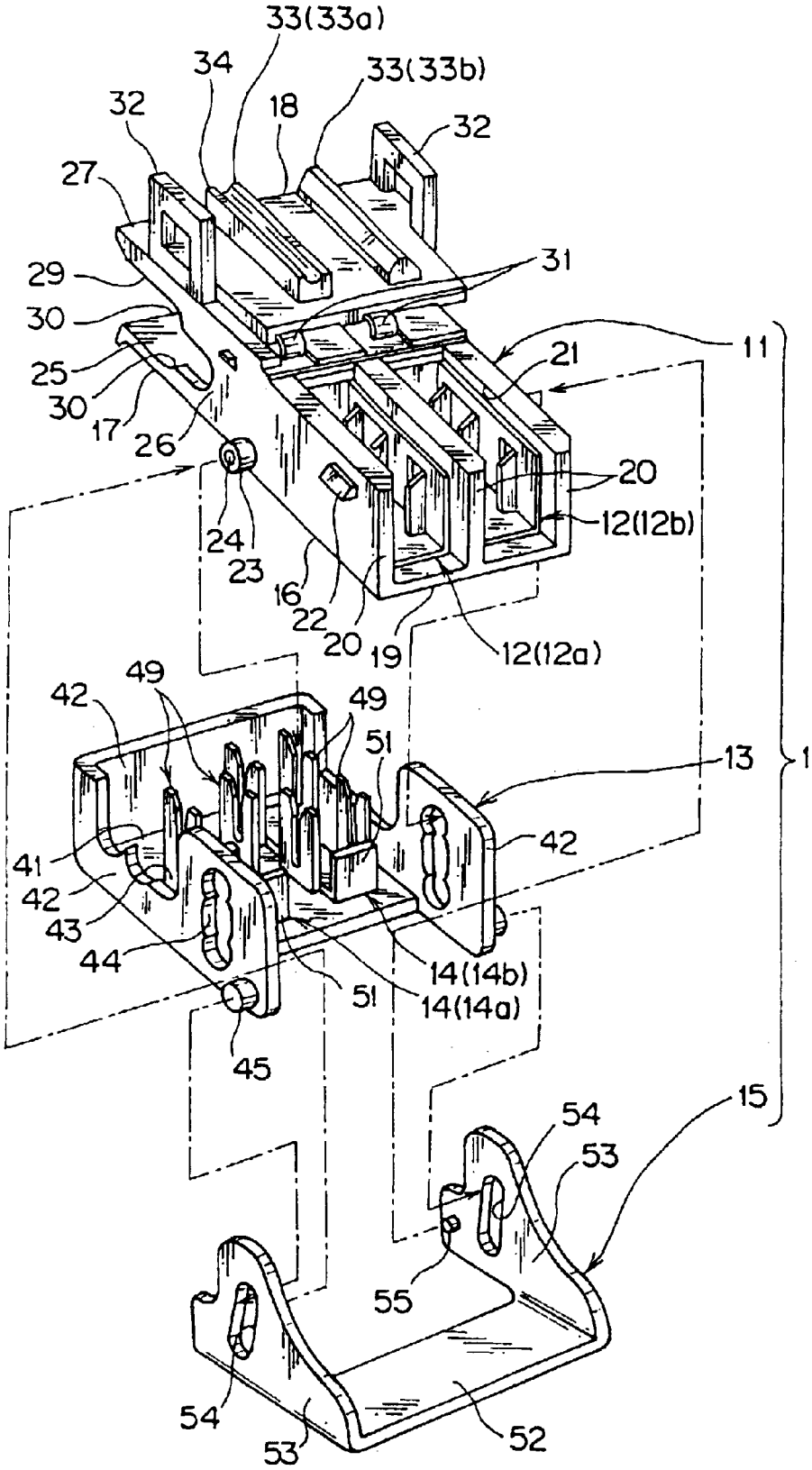
FIG. 4 is an exploded perspective view of the connector shown in FIG. 3.

The second connector housing 13, as shown in FIG. 4, has a rectangular-shape wall 41 when viewing from top and three side walls 42. The side walls 42 rise respectively from outer edges of the wall 41. On a surface of the wall 41, the pressure contact terminal 14 is mounted. Thus, the pressure contact terminal 14 is held in the second connector housing 13. A pair of the side walls 42 opposite mutually with spacing of the three side walls 42 are formed with a second cutout 43, an oval hole 44 and an interlocking projection 45. The second cutout 43 is formed on the side wall 42 from a remote end thereof from the wall 41 toward the wall 41. Thereby, the second cutout 43 is formed on the second connector housing 13 along a direction of sliding the second connector housing 13 against the first connector housing 11, shown by an arrow B in FIG. 1. The second cutout 43 allows the second electric wires 7*a*, 7*b* to go therethrough.

Therefore, a direction of the cutout 29 cutting the first connector housing crosses perpendicularly (intersects) to a direction of the second cutout 43 cutting the second connector housing 13. When the second connector housing is closed to the wire holding portion 17, the cutout 29 and the second cutout 43 cover around outer surface of the second electric wires 7*a*, 7*b*.

A direction of lengthwise of the oval hole 44 crosses perpendicularly to a surface of the wall 41. The slide projection 23 goes into the oval hole 44. The interlocking projection 45 projects from an outer surface of the side wall 42 toward outside of the second connector housing 13.

The second connector housing 13 is mounted on the first connector housing 11 to make the wall 41 thereof in parallel to the walls 19, 27 of the first connector housing 11 and receive the wire holding portion 17 of the first connector housing 11 in the side walls 42 thereof. Simultaneously, the slide projection 23 is inserted into the oval hole 44 of the second connector housing 13. Thereby, the second connector housing 13 is supported slidably freely, along a direction in which the wall 41 and the walls 19, 25 are opposite mutually, by the first connector housing 11.

The second connector housing 13 is slidable against the first connector housing 11 along a direction (shown by an arrow B in FIG. 1) crossing perpendicularly (intersecting) to lengthwise of the first electric wires 3*a*, 3*b* connected with the terminal 12 mounted in the first connector housing 11. In other words, the second connector housing 13 moves close to and apart from the wire holding portion 17 of the first connector housing 11 by sliding against the first connector housing 11.

The pressure contact terminal 14, as shown in FIG. 5, has a wire connecting portion 46 and a second electric contact portion 47 to be electrically connected with the terminal 12. The wire connecting portion 46 has a second bottom wall 48 on which the second electric wire 7*a* or 7*b* is placed and a plurality of pressure contact blades 49. The second bottom wall 48 is formed into rectangular shape when viewed from top. The lengthwise of the second bottom wall 48 crosses perpendicularly to the lengthwise of the second electric wires 7*a*, 7*b* placed thereon.

The plurality of pressure contact blades 49 rise from both edges of width of the second bottom wall 48. The pressure contact blades 49 have respectively a cutout 50 to cut into the cover portion 9 of the second electric wire 7*a* or 7*b* for contacting to the core wires 8. The cutout 50 is formed on the pressure contact blade 49 from a remote end of the pressure contact blade 49 from the second bottom wall 48 toward the second bottom wall 48. Thereby, the wire connecting portions 46, i.e. the pressure contact terminal 14, are connected electrically with the second electric wires 7*a*, 7*b* to be contacted with pressure.

The second electric contact portion 47 has a plate-like second contact piece 51 continuous to the electric wire connecting portion 46. The second contact piece 51 rises from the second bottom wall 48 in the same direction as the pressure contact blade 49. A remote end of the second contact piece 51 from the second bottom wall 48 is movable freely along lengthwise of the first electric wire 3*a* or 3*b* contacted with pressure to the electric wire connecting portion 35 of the terminal 12. The second contact piece 51 is elastically deformable freely in the direction mentioned above.

Figure 6:
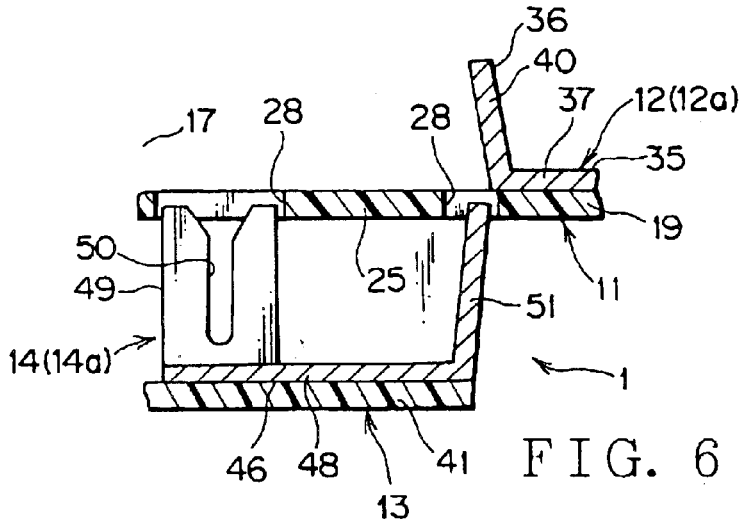
FIG. 6 is a sectional view, showing the second connector housing apart from a wire holding portion of the first connector housing of the connector 1 shown in FIG. 1.

The pressure contact terminal 14 structured above, as shown in FIG. 6, is mounted on the wall 41 of the second connector housing 13, so as to position the second contact terminal 51 near the contact piece 40 of the terminal 12 mounted on the first connector housing 11. Thereby, when the second connector housing 13 is slid toward the wire holding portion 17, the second pressure contact blade 49 goes gradually through the throughhole 28 into the wire holding portion 17 and the second contact piece 51 contacts to the contact piece 40 of the terminal 11, as shown I FIG. 7.

When sliding the second connector housing 13 toward the wire holding portion 17, the contact pieces 40, 51 are elastically deformed in a direction of aparting mutually the remote ends thereof from the first and second bottom walls 37, 48. When sliding the second connector housing 13 toward the wire holding portion 17 so as to insert the pressure contact blade 49 completely into the wire holding portion 17, the contact piece 40, 51 are contacted mutually in a direction of lengthwise of the first electric wires 3*a*, 3*b* mounted on the first connector housing 11. The contact pieces 40, 51 create elastic restoring forces in a direction of approaching each other, as shown by arrows K1, K2 in FIG. 9. The contact pieces 40, 51 contact mutually to create elastic restoring forces mentioned above so that the terminal 12 and the pressure contact terminal 14 are electrically connected mutually.

The pressure contact blade 49 of one pressure contact terminal 14 (indicate 14*a* hereafter), connected electrically with the terminal 12 (indicate 12*a* hereafter) contacted with pressure to the one first electric wire 3*a*, is disposed in the center of lengthwise of the cutout 29 of the wire holding portion 17. The pressure contact blade 49 of the other pressure contact terminal 14 (indicate 14*b* hereafter), connected electrically with the terminal 12 (indicate 12*b* hereafter) contacted with pressure to the other first electric wire 3*b*, is disposed in the both edges of lengthwise of the cutout 29 of the wire holding portion 17.

Figure 16:
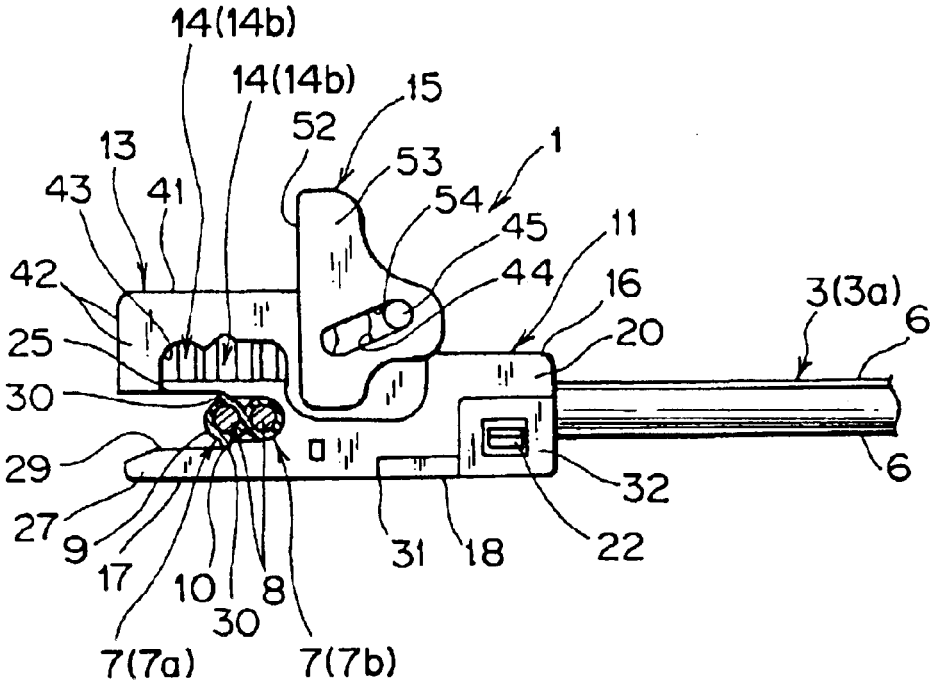
FIG. 16 is a side view, showing the second electric wires inserted into the wire holding portion of the connector shown in FIG. 15.
Figure 18:
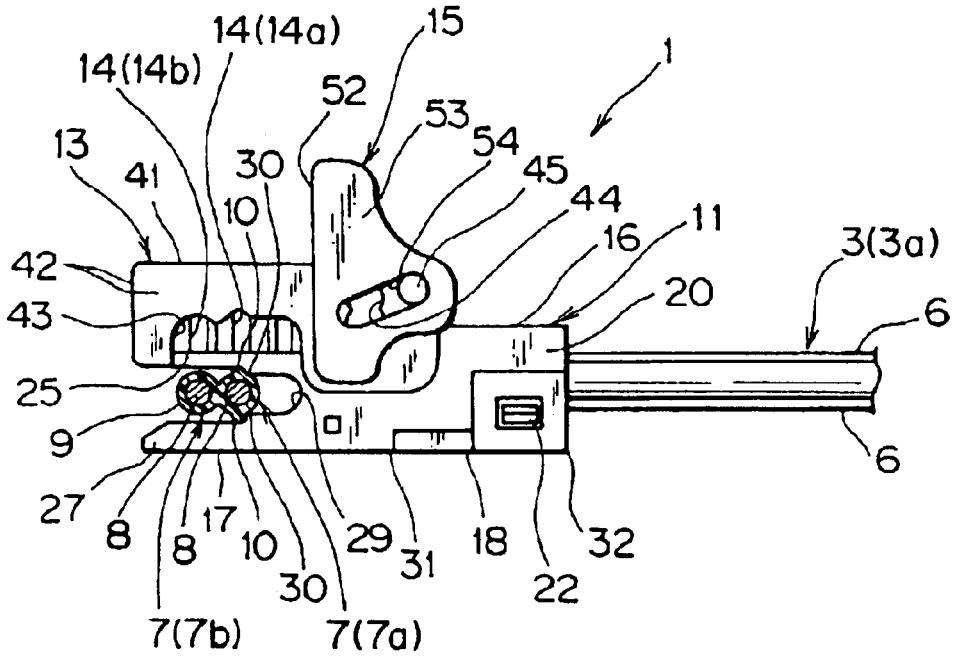
FIG. 18 is a side view, showing the second electric wires inserted into the wire holding portion of the connector provided with the first electric wires shown in FIG. 11 so as to place the one second electric wire farther from the wire holding portion than the other second electric wire.

According to above structure, the second electric wires 7*a*, 7*b* can be inserted through the cutout 29 into the wire holding portion 17 so as to maintain a space between the wall 41 of the second connector housing 13 and the wall 25 of the wire holding portion 17. The direction of lengthwise of the second electric wires 7*a*, 7*b* cross perpendicularly to (intersect) the direction of lengthwise of the first electric wires 3*a*, 3*b*. The one second electric wire 7*a* abuts on the step 30 to be placed in the center of the cutout 29. The other second electric wire 7*b* is placed closer to the terminal receiving portion 16 than the one second electric wire 7*a* is placed as shown in FIG. 16 or is placed farther from the terminal receiving portion 16 than the one second electric wire 7*a* is placed as shown in FIG. 18.

When sliding the second connector housing 13 toward the wire holding portion 17, the contact pieces 40, 51 are contacted mutually to create elastic restoring forces. Simultaneously, the pressure contact blade 49 of the one pressure contact terminal 14*a* is contacted with pressure to the one second electric wire 7*a* and the pressure contact blade 49 of the other pressure contact terminal 14*b* is contacted with pressure to the other second electric wire 7*b*. Thus, the one first electric wire 3*a* is electrically connected through the one terminal 12*a* and the one pressure contact terminal 14*a* with the one second electric wire 7*a*, and the other first electric wire 3*b* is electrically connected through the other terminal 12*b* and the other pressure contact terminal 14*b* with the other second electric wire 7*b*.

The lever member 15 has a rectangular-shape wall 52 when viewing from top and a pair of side walls 53. The pair of side walls 53 rise oppositely with spacing in the same direction from outer edges of the wall 52. The side walls 53 have respectively a projection 55 (one is shown in FIG. 4) and an oval hole 54. The projection 55 is provided at an edge of the side wall 53 and engages with the recess 24 of the slide projection 23. Engaging the projection 55 with recess 24 of the slide projection 23, the lever member 15 is supported rotatably freely around the projection 55 by the first connector housing 11. The oval hole 54 is provided at the center area of the side wall 53 and the interlocking projection 45 is inserted therein.

Figure 14:
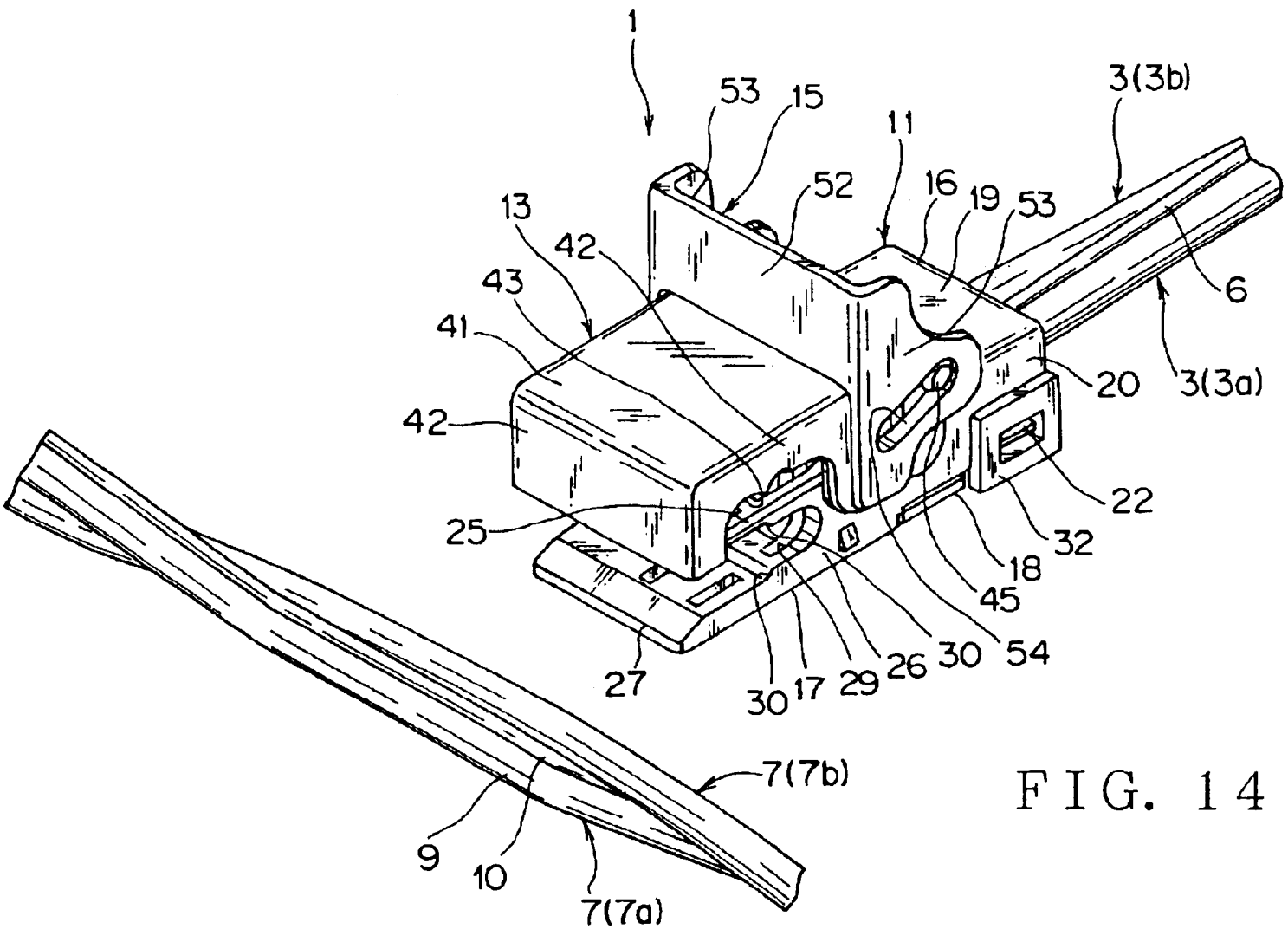
FIG. 14 is a perspective view, showing the connector provided with the first electric wires shown in FIG. 11 will be made close to the second electric wire.

When the lever member 15 is moved so as to make the wall 52 intersect with the walls 19, 25 of the first connector housing 11 as shown in FIG. 14, the second connector housing 13 is placed apart from the wire holding portion 17 by the oval hole 54 and the interlocking projection 45. When the lever member 15 is moved so as to make the wall 52 parallel to the walls 19, 25 of the first connector housing 11 as shown in FIG. 1, the second connector housing 13 is placed close to the wire holding portion 17 by the oval hole 54 and the interlocking projection 45. Thus, by rotating the lever member 55, the second connector housing 13 is moved apart from or close to the wire holding portion 17 of the first connector housing 11. In other words, by rotating the lever member, the second connector housing is slid against the first connector housing 11.

To assemble the connector 1, the terminals 12*a*, 12*b* are firstly received into the terminal receiving grooves 21 of the first connector housing 11. Thereafter, the pressure contact terminals 14*a*, 14*b* are mounted on the wall 41 of the second connector housing 13. Inserting the slide projections 23 into the oval holes 44 of the second connector housing 13, the second connector housing is assembled together in the first connector housing 11. Furthermore, inserting the projections 55 into the recesses 24 of the slide projections 23 of the first connector housing 11 and inserting the interlocking projections 45 into the oval holes 54, the lever member 15 is assembled in the first and second connector housings 11, 13.

When adding a new electronic device in an automobile and connecting electrically the electronic device with the second electric wires 7*a*, 7*b* provided already in the automobile by using the connector 1, the first electric wires 3*a*, 3*b* are firstly joined to the terminals 12*a*, 12*b*. The first electric wires 3*a*, 3*b* are electrically connected with the newly added electronic device on the automobile. Pressing the first electric wires 3*a*, 3*b* between the pressure contact blades 39*a*, 39*b* of the terminals 12*a*, 12*b*, along arrows A in FIG. 10, the first electric wires 3*a*, 3*b* are contacted with pressure to the terminals 12*a*, 12*b*.

Figure 13:
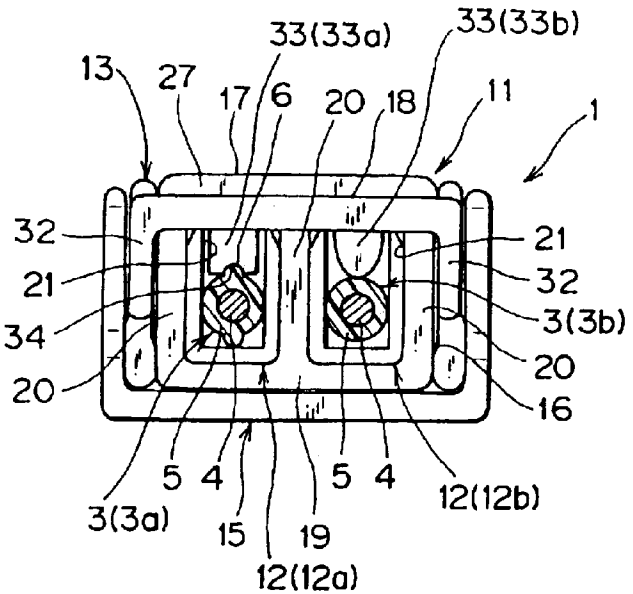
FIG. 13 is a sectional view taken along the line XIII—XIII in FIG. 11.
Figure 11:
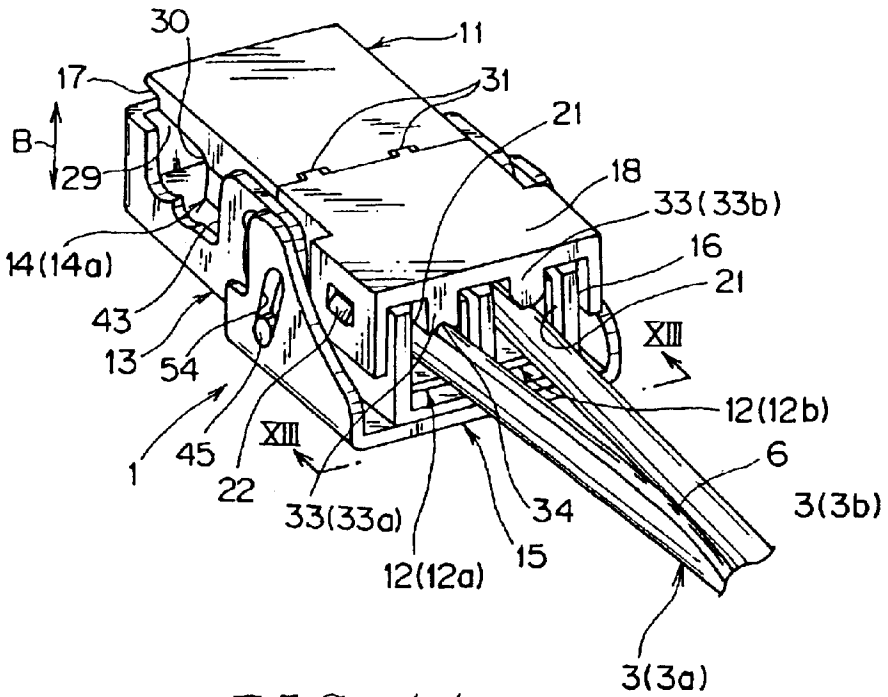
FIG. 11 is a perspective view, showing the first electric wires connected with the connector shown in FIG. 3.

Thereafter, rotating the cover 18 around the hinge 31, the cover lock arm 32 is engaged with the engaging projection 22 as shown in FIG. 11. As shown in FIG. 13, the one first electric wire 3*a* is contacted with pressure to the terminal 12*a* mounted in the terminal receiving groove 21 in which the one projection 33*a* is inserted. The projection 6 of the one first electric wire 3*a* is inserted into the concave groove 34 of the one projection 33*a*. The other first electric wire 3*b* is contacted with pressure to the terminal 12*b* mounted in the terminal receiving groove 21 in which the other projection 33*b* is inserted.

When the other projection 33*b* interferes with the projection 6 of the one first electric wire 3*a* and the cover lock arm 32 of the cover 18 can not be engaged with the engaging projection 22, the first electric wires 3*a*, 3*b* have to be removed from the terminals 12*a*, 12*b*. Turning the first electric wires 3*a*, 3*b* over and contacting the first electric wires 3*a*, 3*b* with pressure to the terminals 12*a*, 12*b* in right position, the first electric wires 3*a*, 3*b* are mounted in the first connector housing 11.

Thereafter, the lever member 15 is positioned to make the wall 52 intersect with walls 19, 25 of the first connector housing 11 for maintaining the second connector housing 13 apart from the wire holding portion 17.

The wire holding portion 17 of the first connector housing 11 of the connector 1 provided with the first electric wires 3*a*, 3*b* is made to be close to the mounted second electric wires 7*a*, 7*b*. The second electric wires 7*a*, 7*b* are inserted through the cutout 29 into the wire holding portion 17. At this time, the projection 6 of the one second electric wire 7*a* abuts on the step 30 so that the one second electric wire 7*a* is placed at the center of the cutout 29. The other second electric wire 7*b* is placed closer to the terminal receiving portion 16 than the one second electric wire 7*a* is placed as shown in FIG. 16 or is placed farther from the terminal receiving portion 16 than the one second electric wire 7*a* is placed as shown in FIG. 18.

Thereafter, the lever member 15 is rotated until the wall 52 hangs over the wall 19 of the terminal receiving portion 16. The second connector housing 13 is slid toward the wire holding portion 17 by the oval holes 54 and the interlocking projections 45. Thereby, the pressure contact blades 49 of the pressure contact terminals 14*a*, 14*b* are inserted gradually through the throughholes 28 of the wall 25 of the wire holding portion 17 into the wire holding portion 17 and the contact pieces 40 of the terminals 12*a*, 12*b* are moved gradually close to the second contact pieces 51 of the pressure contact terminals 14*a*, 14*b*.

Figure 17:
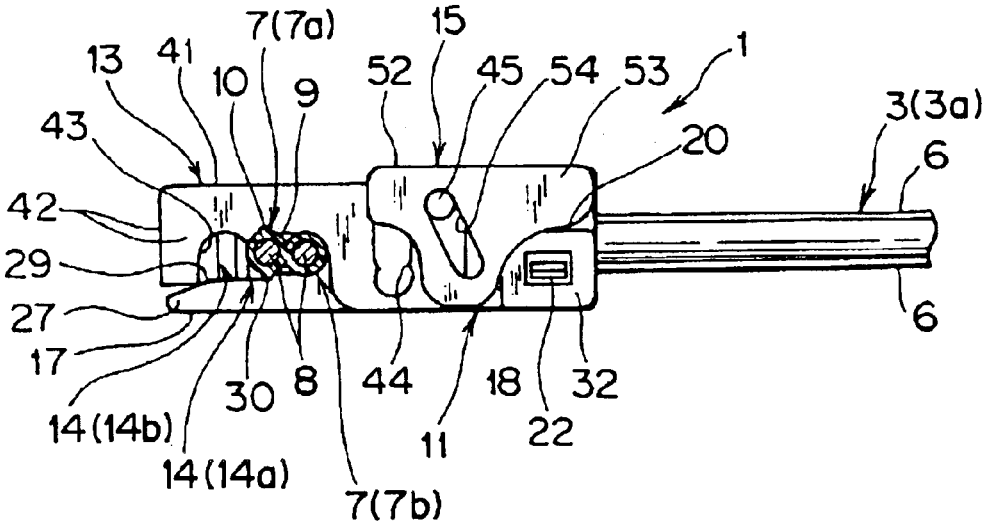
FIG. 17 is a side view, showing the second connector housing being slid toward the wire holding portion by rotating the lever member from a condition shown in FIG. 16.
Figure 19:
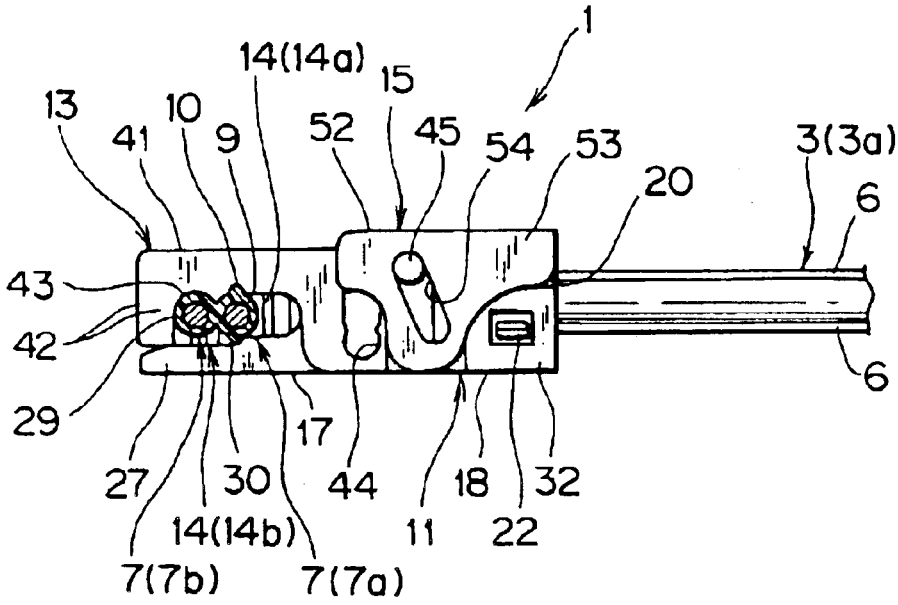
FIG. 19 is a side view, showing the second connector housing made close to the wire holding portion by rotating the lever member from a condition shown in FIG. 18.

The second electric wire 7*a*, 7*b* are contacted with pressure to the pressure contact blades 49 of the pressure contact terminals 14*a*, 14*b* and the contact pieces 40, 51 contact mutually to create mutually elastic restoring forces in a direction of approaching each other. The wall 52 of the lever member 15 hangs over the wall 19 of the terminal receiving portion 16 as shown in FIG. 17 or 19.

Thus, the one first electric wire 3*a* and the one second electric wire 7*a* are electrically connected and the other first electric wire 3*b* and the other second electric wire 7*b* are electrically connected. Thereby, newly added electronic device can be electrically connected with the mounted second electric wires 7*a*, 7*b*.

According to this embodiment, holding the second electric wires 7*a*, 7*b* in the wire holding portion 17, and sliding the second connector housing 13 toward the wire holding portion 17, the second electric wires 7*a*, 7*b* are contacted with pressure to the pressure contact terminals 14*a*, 14*b*. Thereby, the terminals 12*a*, 12*b* are electrically connected with the pressure contact terminal 14*a*, 14*b*. Accordingly, holding the second electric wires 7*a*, 7*b* in the wire holding portion 17, and sliding the second connector housing 13 toward the wire holding portion 17, the first electric wires 3*a*, 3*b* and the second electric wires 7*a*, 7*b* are electrically connected. Therefore, the first electric wires 3*a*, 3*b* and the second electric wires 7*a*, 7*b* can be electrically connected easily and securely.

The cutout 29 is formed on the first connector housing 11 so that the wire holding portion 17 can hold the second electric wires 7*a*, 7*b* securely. The wire holding portion 17 holds the second electric wires 7*a*, 7*b* to intersect with the first electric wires 3*a*, 3*b*. Thereby, the second electric wires 7*a*, 7*b* can be inserted easily into the wire holding portion 17 and can be contacted with pressure securely to the pressure contact terminals 14*a*, 14*b*. Thus, the second electric wires 7*a*, 7*b* can be inserted easily into the wire holding portion 17 and can be connected easily with the first electric wires 3*a*, 3*b*.

The second cutout 43 is formed on the second connector housing 13 along a direction of sliding the second connector housing 13 against the first connector housing 11. Therefore, a direction of the cutout 29 cutting the first connector housing 11 intersects to a direction of the second cutout 43 cutting the second connector housing 13. When the second connector housing 13 is slid toward the wire holding portion 17, and the second electric wires 7*a*, 7*b* are contacted with pressure to the pressure contact terminals 14*a*, 14*b*, the cutout 29 and the second cutout 43 cover around outer surface of the second electric wires 7*a*, 7*b*. Therefore, the second electric wires 7*a*, 7*b* connected with the first electric wires 3*a*, 3*b* can be prevented from falling out unexpectedly.

The contact pieces 40 of the terminals 12*a*, 12*b* and the second contact pieces 51 of the pressure contact terminals 14*a*, 14*b* create elastic restoring forces in a direction of approaching each other along lengthwise of the first electric wires 3*a*, 3*b*. Thereby, when sliding the second connector housing 13 toward the wire holding portion 17, the terminals 12*a*, 12*b* and the pressure contact terminals 14*a*, 14*b* are electrically connected securely. Therefore, the first electric wires 3*a*, 3*b* and the second electric wires 7*a*, 7*b* are electrically connected securely.

The contact pieces 40, 51 rise from the first or second bottom walls 37, 48 and remote ends of the contact pieces 40, 51 from the bottom walls 37, 48 are movable freely along lengthwise of the first electric wires 3*a*, 3*b*. Thereby, when sliding the second connector housing 13 toward the wire holding portion 17, the contact pieces 40, 51 are contacted mutually to create securely elastic restoring forces in a direction of approaching each other. Therefore, the first electric wires 3*a*, 3*b* and the second electric wires 7*a*, 7*b* are electrically connected securely.

By rotating the lever member 15, the second connector housing 13 is slid. Thereby, the second connector housing 13 can be slid securely and the second electric wires 7*a*, 7*b* can be contacted with pressure securely to the pressure contact terminals 14*a*, 14*b*. Therefore, the first electric wires 3*a*, 3*b* and the second electric wires 7*a*, 7*b* are electrically connected more securely. Furthermore, the second connector housing 13 can be slid with small force under lever operation, and the second electric wires 7*a*, 7*b* can be contacted with pressure securely to the pressure contact terminals 14*a*, 14*b*.

Figure 20:
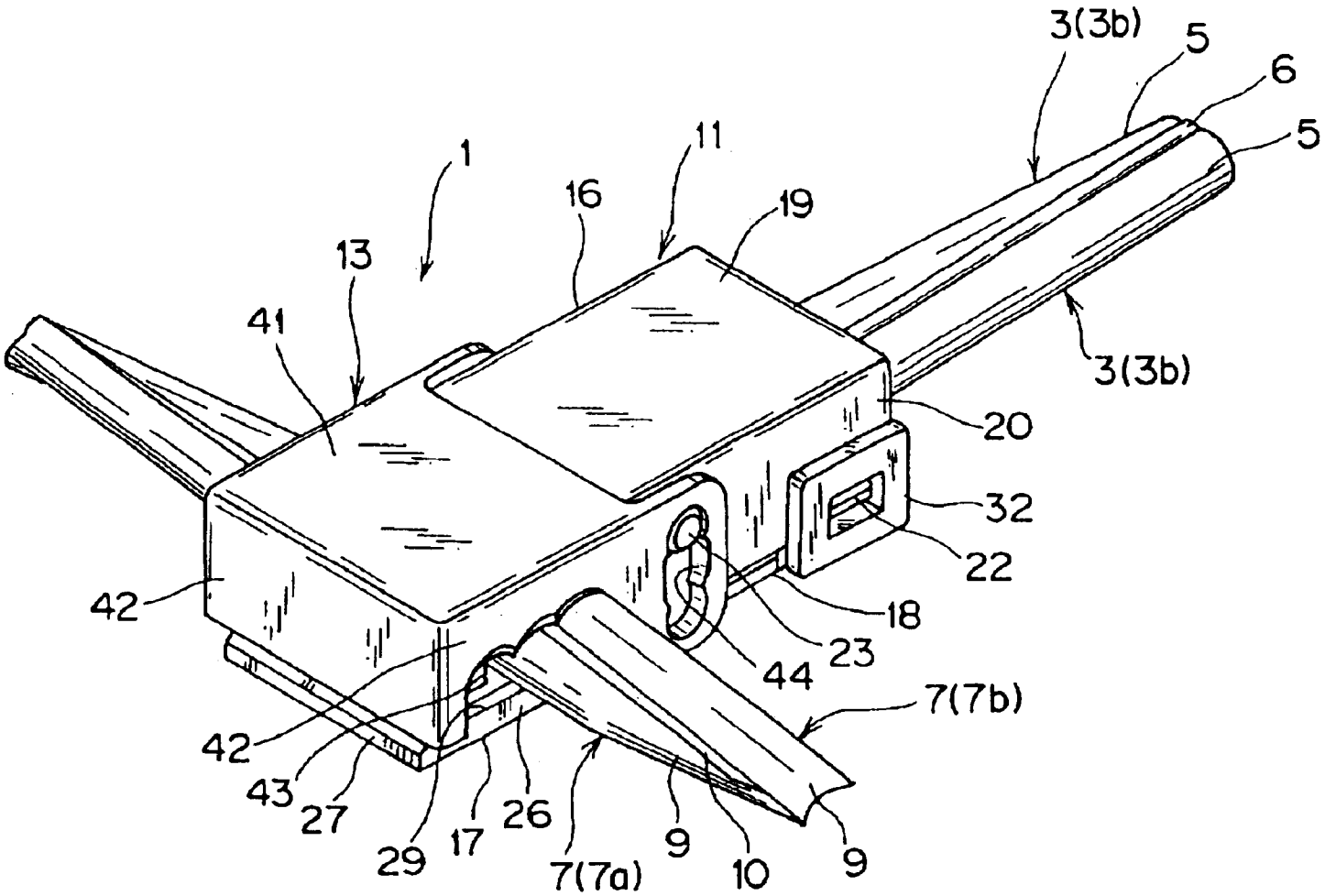
FIG. 20 is a perspective view of a connector of the second embodiment according to this invention.

A connector of a second embodiment according to this invention will now be described with reference to FIGS. 20, 21. The same components as the first embodiment mentioned above are marked by the same marking and explanation for the components is omitted. The connector 1 according to this embodiment is a connector removed the lever member 15 from the connector 1 according to the first embodiment mentioned above. Other structure is the same as the connector according to the first embodiment.

Figure 21:
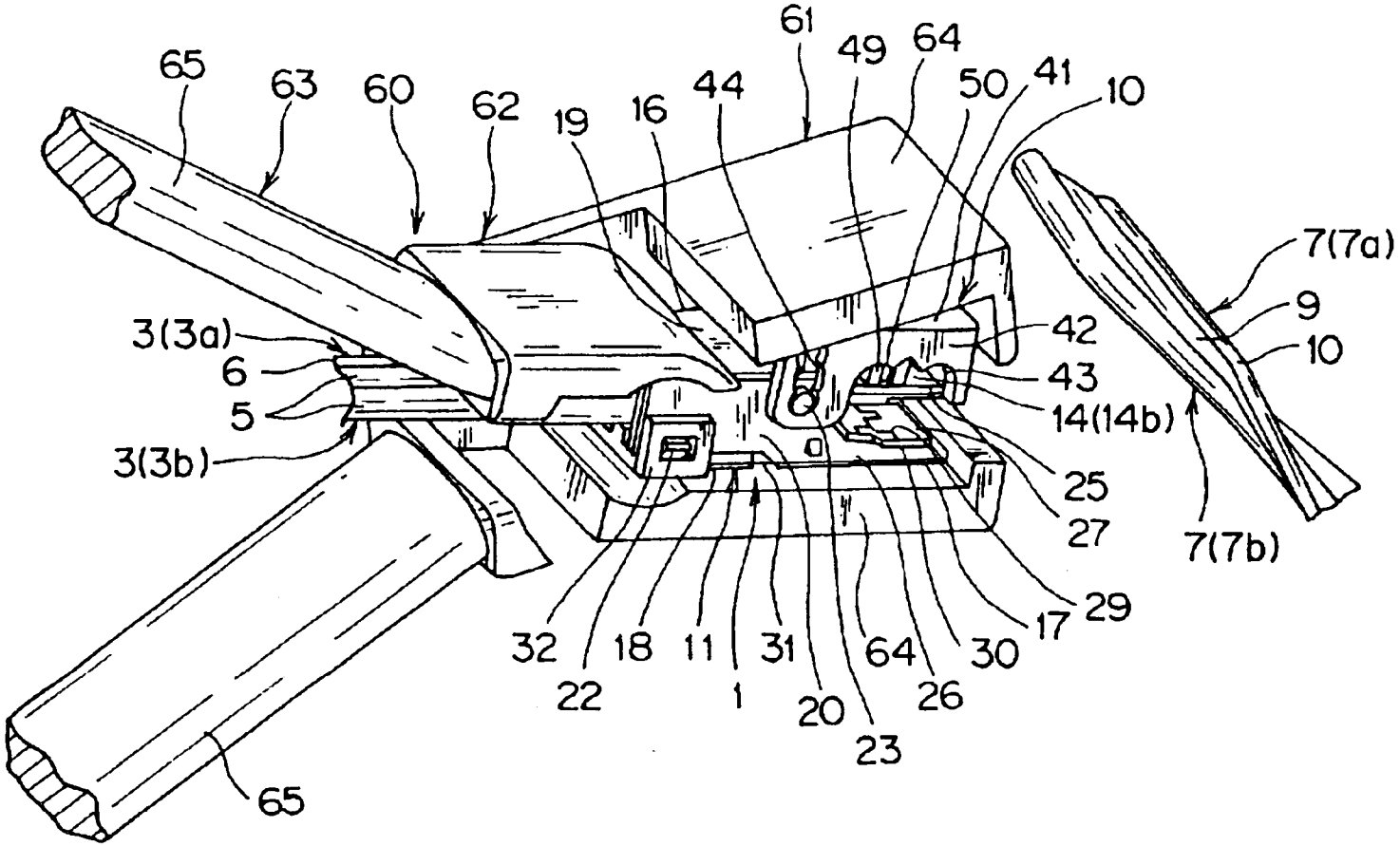

When the second electric wires 7*a*, 7*b* are contacted with pressure to the pressure contact terminals 14*a*, 14*b* in the connector 1 of this embodiment, a jig 60 shown in FIG. 21 is used. The jig 60 is structured like a pair of pliers, and has a acting portion 61, a fulcrum portion 62 and a loading portion 63. The acting portion has a pair of clamping pieces 64 closing and aparting mutually. The pair of clamping pieces 64 clamp the connector 1 therebetween. The fulcrum portion 62 supports the pair of clamping pieces 64 freely closing and aparting mutually. The loading portion 63 a pair of handles 65 closing and aparting mutually by interlocking the pair of clamping pieces 64. In the jig 60 having structure mentioned above, closing the pair of handles 65 mutually, the pair of clamping pieces 64 are closed to each other.

The connector 1 of this embodiment is assembled similarly as the connector of the first embodiment. Firstly, the terminals 12*a*, 12*b* are received into the terminal receiving grooves 21 of the first connector housing 11. The pressure contact terminals 14*a*, 14*b* are mounted on the wall 41 of the second connector housing 13. Inserting the slid projections 23 into the oval holes 44 of the second connector housing 13, the first connector housing 11 and the second connector housing 13 are assembled together.

When adding a new electronic device in an automobile and connecting electrically the electronic device with the second electric wires 7*a*, 7*b* provided already in the automobile by using the connector 1, the first electric wires 3*a*, 3*b* are firstly joined to the terminals 12*a*, 12*b* similarly as the first embodiment. Thereafter, rotating the cover 18 around the hinge 31, the cover lock arm 32 is engaged with the engaging projection 22.

The connector 1 provided with the first electric wires 3*a*, 3*b* is clamped between the pair of clamping pieces 64 of the jig 60 as shown in FIG. 21. The wire holding portion 17 of the first connector housing 11 of the connector 1 is made to be close to the mounted second electric wires 7*a*, 7*b*. The second electric wires 7*a*, 7*b* are inserted through the cutout 29 into the wire holding portion 17. At this time, the one second electric wire 7*a* is placed at the center of the cutout 29. The other second electric wire 7*b* is placed closer to the terminal receiving portion 16 than the one second electric wire 7*a* is placed or is placed farther from the terminal receiving portion 16 than the one second electric wire 7*a* is placed.

Thereafter, by making the pair of handles 65 close to each other, the second connector housing 13 is slid toward the wire holding portion 17. Thereby, the pressure contact blades 49 of the pressure contact terminals 14*a*, 14*b* are inserted gradually through the throughholes 28 of the wall 25 of the wire holding portion 17 into the wire holding portion 17 and the contact pieces 40 of the terminals 12*a*, 12*b* are moved gradually close to the second contact pieces 51 of the pressure contact terminals 14*a*, 14*b*. The second electric wire 7*a*, 7*b* are contacted with pressure to the pressure contact blades 49 of the pressure contact terminals 14*a*, 14*b* and the contact pieces 40, 51 contact mutually to create mutually elastic restoring forces in a direction of approaching each other.

Thus, the one first electric wire 3*a* and the one second electric wire 7*a* are electrically connected and the other first electric wire 3*b* and the other second electric wire 7*b* are electrically connected. Thereby, newly added electronic device can be electrically connected with the mounted second electric wires 7*a*, 7*b*.

According to this embodiment, holding the second electric wires 7*a*, 7*b* in the wire holding portion 17 similarly as the first embodiment, and sliding the second connector housing 13, the first electric wires 3*a*, 3*b* and the second electric wires 7*a*, 7*b* are electrically connected. Therefore, the first electric wires 3*a*, 3*b* and the second electric wires 7*a*, 7*b* can be electrically connected easily and securely.

The cutout 29 is formed on the first connector housing 11 so that the wire holding portion 17 can hold the second electric wires 7*a*, 7*b* securely. The wire holding portion 17 holds the second electric wires 7*a*, 7*b* to intersect with the first electric wires 3*a*, 3*b*. Thereby, the second electric wires 7*a*, 7*b* can be inserted easily into the wire holding portion 17 and can be contacted with pressure securely to the pressure contact terminals 14*a*, 14*b*. Therefore, the first electric wires 3*a*, 3*b* and the second electric wires 7*a*, 7*b* can be connected easily with each other.

The second cutout 43 is formed on the second connector housing 13 along a direction of sliding the second connector housing 13 against the first connector housing 11. Thereby, when the second connector housing 13 is slid toward the wire holding portion 17, and the second electric wires 7*a*, 7*b* are contacted with pressure to the pressure contact terminals 14*a*, 14*b*, the cutout 29 and the second cutout 43 cover around outer surface of the second electric wires 7*a*, 7*b*. Therefore, the second electric wires 7*a*, 7*b* connected with the first electric wires 3*a*, 3*b* can be prevented from falling out unexpectedly.

The contact pieces 40 of the terminals 12*a*, 12*b* and the second contact pieces 51 of the pressure contact terminals 14*a*, 14*b* create elastic restoring forces in a direction of approaching each other along lengthwise of the first electric wires 3*a*, 3*b*. Thereby, when sliding the second connector housing 13 toward the wire holding portion 17, the terminals 12*a*, 12*b* and the pressure contact terminals 14*a*, 14*b* are electrically connected securely. Therefore, the first electric wires 3*a*, 3*b* and the second electric wires 7*a*, 7*b* are electrically connected securely.

The contact pieces 40, 51 rise from the first or second bottom walls 37, 48 and remote ends of the contact pieces 40, 51 from the bottom walls 37, 48 are movable freely along lengthwise of the first electric wires 3*a*, 3*b*. Thereby, when sliding the second connector housing 13 toward the wire holding portion 17, the contact pieces 40, 51 are contacted mutually to create securely elastic restoring forces in a direction of approaching each other. Therefore, the first electric wires 3*a*, 3*b* and the second electric wires 7*a*, 7*b* are electrically connected more securely.

By making the pair of handles 65 of the jig 60, the second connector housing 13 is slid. Thereby, the second connector housing 13 can be slid securely and the second electric wires 7*a*, 7*b* can be contacted with pressure securely to the pressure contact terminals 14*a*, 14*b* Therefore, the first electric wires 3*a*, 3*b* and the second electric wires 7*a*, 7*b* are electrically connected more securely. According to the first and second embodiments, a pair of the first electric wires 3*a*, 3*b* and a pair of the second electric wires 7*a*, 7*b* are connected. In this invention, one first electric wire 3 and one second electric wire may be connected and three or more first electric wires 3 and three or more second electric wires 7 can be connected.

While the forms of the invention herein disclosed constitute presently preferred embodiments, many others are possible. It is not intended herein to mention all the possible embodiments of the invention which will be apparent to those skilled in the art. It is understood that the term used herein are merely descriptive rather than limiting, in that various changes may be made without departing from the scope of this invention as defined by the following claims.

What is claimed is:

1. A connector, comprising:

a terminal connected electrically with a first electric wire;

a first connector housing receiving the terminal;

a second connector housing slidable against the first connector housing; and a pressure contact terminal, held in the second connector housing and contacted electrically to a second electric wire, being connectable electrically with said terminal, wherein the first connector housing is provided with a wire holding portion for holding the second electric wire, wherein the second connector housing is slidable freely against the first connector housing along a direction intersecting with the first electric wire, wherein the pressure contact terminal is contacted with pressure to the second electric wire by sliding the second connector housing toward the wire holding portion of the first connector housing holding the second electric wire.

2. The connector according to claim 1, wherein said wire holding portion has a cutout formed in the first connector housing by cutting out along lengthwise of the first electric wire and holds the second electric wire so as to intersect with the first electric wire passed therethrough.

3. The connector according to claim 2, wherein said second connector housing has a second cutout formed along a direction of sliding toward the first connector housing to make the second electric wire pass through the second cutout.

4. The connector according to claim 1, 2 or 3, wherein said terminal is connected with the pressure contact terminal by sliding the second connector housing toward the wire holding portion of the first connector housing holding the second electric wire.

5. The connector according to claim 1, 2 or 3, wherein said terminal has a first electric contact portion for being connected electrically with the pressure contact terminal, wherein the pressure contact terminal has a second electric contact portion for being connected electrically with said terminal, wherein the first electric contact portion and the second electric contact portion are contacted mutually in a direction of lengthwise of the first electric wire so as to create respectively elastic restoring forces in a direction of approaching each other along lengthwise of the first electric wire, when the second electric wire is contacted with pressure to the pressure contact terminal by sliding the second connector housing toward the wire holding portion.

6. The connector according to claim 5, wherein said terminal has a first bottom wall for placing the first electric wire thereon, wherein the pressure contact terminal has a second bottom wall for placing the second electric wire thereon, wherein the first electric contact portion is formed into plate rose from the first bottom wall and has a contact piece movable freely along lengthwise of the first electric wire at the remote end thereof from the first bottom wall, wherein the second electric contact portion is formed into plate rose from the second bottom wall and has a second contact piece movable freely along lengthwise of the first electric wire at the remote end thereof from the second bottom wall.

7. The connector according to any of claim 1, 2 or 3 wherein said first connector housing is provided with a lever member supported freely and rotatably thereto for sliding the second connector housing toward the first connector housing by the rotation thereof.

* * * * *